US006314736B1

(12) United States Patent
Daudel et al.

(10) Patent No.: US 6,314,736 B1
(45) Date of Patent: Nov. 13, 2001

(54) EXHAUST GAS TURBINE OF A TURBOCHARGER FOR AN INTERNAL COMBUSTION ENGINE

(75) Inventors: Helmut Daudel, Schorndorf; Wolfgang Erdmann; Peter Fledersbacher, both of Stuttgart; Carsten Funke, Kernen; Paul Löffler; Siegfried Sumser, both of Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/558,834

(22) Filed: Apr. 26, 2000

(30) Foreign Application Priority Data

Dec. 21, 1999 (DE) ..... 199 61 613

(51) Int. Cl.[7] ..... F02D 23/00
(52) U.S. Cl. ..... 60/602; 60/605.2; 415/148
(58) Field of Search ..... 60/602, 605.2; 415/148, 157, 158

(56) References Cited

U.S. PATENT DOCUMENTS 5,146,752 * 9/1992 Bruestle ..... 60/602
5,214,920 * 6/1993 Leavesley ..... 60/602
5,600,956 * 2/1997 Nytomt ..... 60/602
5,758,500 * 6/1998 Sumser et al. ..... 60/602
5,855,117 * 1/1999 Sumser et al. ..... 60/602

FOREIGN PATENT DOCUMENTS 195 43 190 C2 11/1995 (DE) .
198 38 928 C1 8/1998 (DE) .
0010130002 AA 11/1987 (JP) .

OTHER PUBLICATIONS

Article by A. Feuerstein and W. Bialojan entitled "Beschichten im Vakuum" dated Dec. 1992.

* cited by examiner

*Primary Examiner*—Hoang Nguyen
(74) *Attorney, Agent, or Firm*—Klaus J. Bach

(57) ABSTRACT

An exhaust gas turbine portion of a vehicle engine turbocharger is provided with at least one variable guide-blade cascade with guide blades in a nozzle opening to the turbocharger rotor for effectively changing the cross section of the exhaust flow to the rotor wherein the angle of the guide blades is selectively settable by an adjusting device. The width dimension of the gap between the ends of the guide-blade cascade and the casing wall defining the nozzle is adjustable between a substantially zero gap dimension and a maximum gap dimension.

24 Claims, 3 Drawing Sheets

EXHAUST GAS TURBINE OF A TURBOCHARGER FOR AN INTERNAL COMBUSTION ENGINE

CROSS REFERENCE TO RELATED APPLICATIONS

Priority is claimed under 35 U.S.C. 119 with respect to German Patent Application 199 61 613.2-13 filed on Dec. 21, 1999.

BACKGROUND OF THE INVENTION

1. Field of the Invention

The invention relates to an exhaust gas turbocharger for an internal combustion engine and specifically to the turbine portion having variably adjustable blades.

2. Description of Related Art

A generic exhaust gas turbine for a turbocharger is disclosed in DE 195 43 190 C2 which shows adjustable stop bodies in an annular nozzle arrangement to provide a variable adjustable blade arrangement. The stop bodies are utilized to increase the operating reliability of the exhaust gas turbine particularly in an engine braking mode of operation.

In addition, DE 198 38 928 C1 discloses in an exhaust gas turbocharger a turbine portion having a variably adjustable series of guide-blades. For each guide-blade, a sealing element is provided and located in a pressurized space. The sealing element design is in the form of sealing cups adapted to be sealingly pressed onto the free end of a blade so that the series gap formed at the end of the blade is completely sealed off. A disadvantage of this, however, is that a large number of sealing elements is required, one for each blade, and this increases expense and the susceptibility to operating faults. Furthermore, during adjustment of the blade and sealing member high adjusting forces have to be exerted to overcome frictional forces generated by pressing the sealing element onto the blade. Moreover, there is the risk of damage caused by a complete elimination of the end gap which allows an undesirably high rotational speed of the turbocharger particularly in an engine braking mode from relatively high engine speeds. Another problem with this seal design may occur by an undesirably great thermal expansion of an associated blade.

Another device is shown in JP 001 130002 AA which discloses an adjustable series of blades in which a precisely defined sealing gap is set by means of a spacer member.

SUMMARY OF THE INVENTION

The present invention utilizes a variably adjustable exhaust gas turbine whose efficiency is achieved by blade adjustment as a function of the operating state of the internal combustion engine. In particular, the subject device provides an improvement in acceleration behavior of the turbine particularly during an engine-braking mode of operation and in driving modes, even at low engine rotational speeds. It provides a rapid build-up of the engine inlet pressure developed by the turbocharger and therefore a corresponding rapid build-up of braking or driving torque. Accordingly, any overload of the exhaust gas turbine or of entire exhaust gas turbocharger under extreme conditions is avoided.

This object is achieved, according to the invention, by means of apparatus and by a regulating process as described hereinafter. Specifically, the exhaust gas turbocharger can always be optimally adapted or set-up relative to a desirable operating state of the internal combustion engine by controlling the axial gap between a maximum allowable gap and substantially a zero gap. Thus, for example, after a an initial adjustment of the series of blades, the axial end gaps can be advantageously reduced between the maximum to near zero by a clamping action. Resultantly, acceleration is improved even at a low engine rotational speed and following an engine-braking mode of operation. At the same time, by reducing end gap losses, a more rapid build-up of the inlet charge pressure to the engine and consequently a rapid build-up of braking torque can be achieved.

In an advantageous refinement of the invention, the guide blades can be clamped, for example by an annular piston, between a part of the casing wall which surrounds or forms the angular nozzle. This clamping inhibits excitations of the guide blades in the series of guide-blades.

Conversely, by increasing the axial gap in a controlled manner between zero and a maximum, the efficiency of the turbine portion can be readily controlled.

A particular advantageous feature of the gap varying or setting control of the gas turbocharger according to the invention is that the exhaust gas turbine can be operated close to its desired rotative speed so that the exhaust gas turbine has a correspondingly high efficiency. By a controlled increase in the axial gap between the blades and the housing, the effectiveness and speed of the turbocharger can be decreased particularly in an upper range of engine speeds. This inhibits damage to the exhaust gas turbine or to the exhaust gas turbocharger by the corresponding lowering of efficiency.

BRIEF DESCRIPTION OF THE DRAWINGS

Advantageous refinements and developments of the invention may be gathered from the exemplary embodiment described hereinafter with reference to the drawing, in which.

DESCRIPTION OF THE PREFERRED EMBODIMENTS

Figure 1:
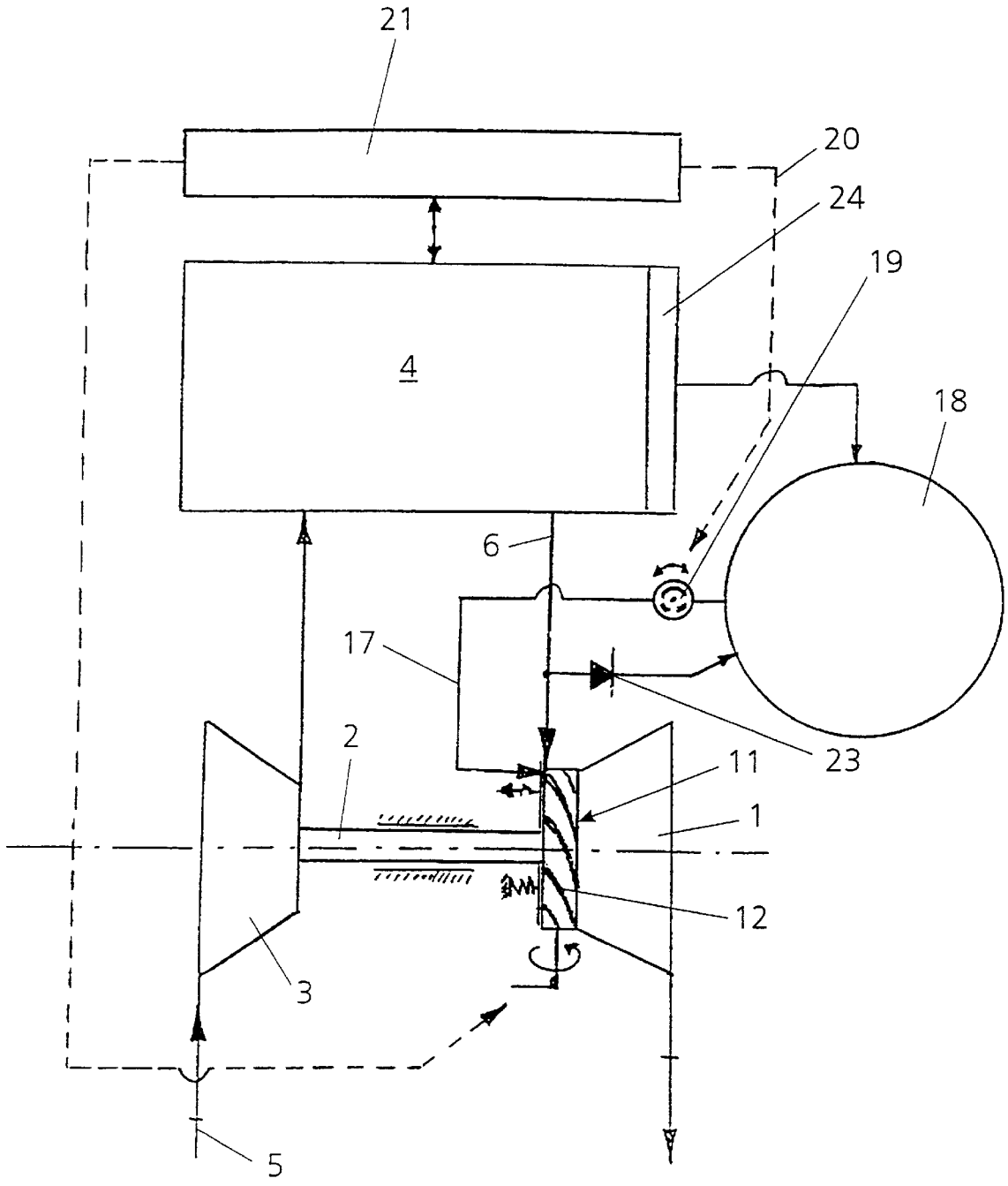
FIG. 1 is a diagrammatical illustration of an exhaust gas turbocharger with the exhaust gas turbine portion regulated according to the invention.

The general design and operation of an exhaust gas turbocharger is generally known and therefore its basic configuration is not discussed in great detail. A first exemplary embodiment of the invention is described with reference to FIGS. 1 and 2 in which an exhaust gas turbine portion 1 of a turbocharger is shown. The turbine portion 1 is arranged in the exhaust gas stream discharged by an associated internal combustion engine 4. The turbocharger includes a drive shaft 2 connecting turbine portion 1 to a compressor portion 3 of the turbocharger. The compressor portion 3 is arranged in an air intake flow or line 5 for feeding compressed air to the engine 4.

Figure 2:
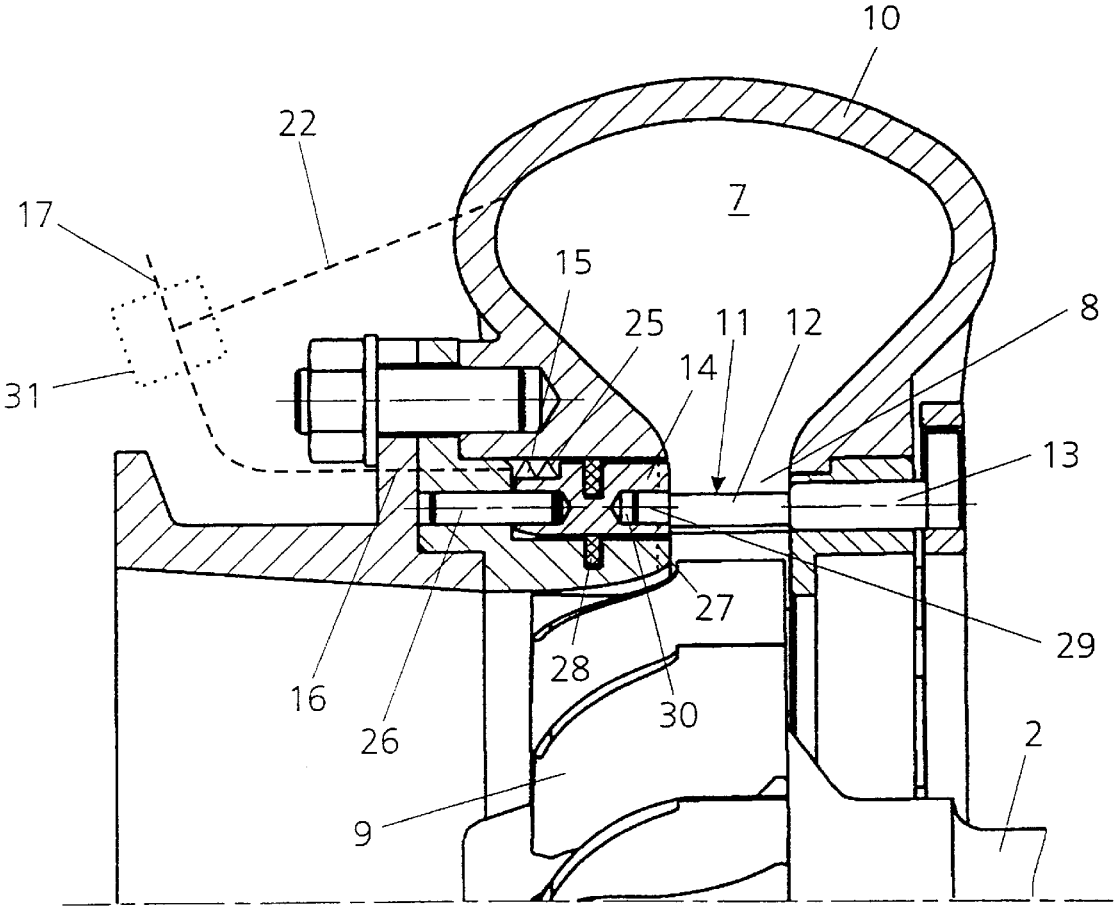
FIG. 2 is a cross-sectional view taken through the turbine portion showing a first design of an annular control piston.

The turbine portion 1 is in an exhaust gas flow line 6 extending from engine 4. As best seen in FIG. 2, the gas turbine portion 1 has a surrounding spiral flow duct 7 operating to direct exhaust gas from inlet duct 7 through an annular opening or nozzle 8 to a turbine wheel or rotor 9 which is attached to the drive shaft 2. A common enclosure housing or casing 10 supports and envelopes the turbine wheel or rotor 9 and forms the inlet flow duct 7 and the annular nozzle opening 8. Specifically, the annular nozzle opening 8 is defined between axially spaced walls of the casing 10.

A guide blade cascade or series 11 is located in the nozzle opening 8 and includes a multiplicity of individual guide blades 12. The angular positioning relative to the flow of exhaust gas through the nozzle 8 of the guide blades 12 is adjustable by a guide blade adjusting device 13 so that the effective cross-sectional flow area of the nozzle opening can be selectively adjusted or set between a maximum opened operative position and a substantially closed operative position.

In FIG. 2, an annular piston 14 is shown supported by the casing 10 adjacent the leftward ends of guide blades cascade 11. The rightward end of the annular piston 14 acts as a wall adjacent the end portions of the guide blades 12. A pressure space 15 is defined at an opposite end portion of the annular piston 14 which faces away from the guide blades 12. Pressure space 15 is connected via a pressure connection 16 to a pressurized feedline 17. In a preferred form, where possible, the pressure medium used for pressure space 15 is an on-board compressed-air network. Otherwise it is possible to provide for this pressurization by a specific pressure system including a pressure accumulator 18 as seen in FIG. 1.

In order to achieve a great braking power, particularly in an engine braking mode and even at low engine speeds, the axial gap between the leftward end of the guide blades 12 and the adjacent rightward end wall of the annular piston 14 needs to be minimized or preferably eliminated. However, complete elimination of the axial gap has hitherto not been readily possible in the prior art because of thermal expansion of the guide blades 12 and the angle-setting adjusting or actuation device 13 used for the guide blades. In the subject arrangement, By means of the annular piston 14 which forms the axial wall defining blade movement or adjustment travel of the blades 12, the axial gap between the ends of the guide blades 12 and the adjacent piston end or wall can be desirably established at various settings.

The regulation or setting of the extent of the axial gap is accomplished as follows: a force on the annular piston 14 for adjusting its position relative to the end so the blades 12 is developed from the fluid pressure of feedline 17 and the pressure accumulator 18. Alternately, the pressure could be from the on-board compressed-air network. Appropriate desired pressure changes or pressure modulations are achieved by a pressure-regulating or shut-off device 19 which is activated by an engine control device 21 via control line 20.

Alternatively, a control pressure may be generated via a branch line 22 connected as shown by broken lines in FIG. 2 to the pressure connection 16 via a 3-way valve 31.

The pressure accumulator 18 shown in FIG. 1 may be charged by exhaust gas pressure from exhaust gas line 6 via a non-return valve 23. Charging action may also be applied to the pressure accumulator 18 and thus to the pressure space 15 via an engine compressor 24 shown in FIG. 1.

The gap setting is carried out under control of the setting of the regulating device 19. Axial gap sizes and the level of the force pressing the end of the annular piston 14 onto the end of the guide blades 12 are implemented by pressure modulation via regulating device 19. If required, the annular piston 14 may also be designed with a spring 25 which is preferably arranged in the pressure space 15 and thus would ensure a neutral position or an initial gap.

Two examples of an alternate application of the regulating process for varying the axial gap at the ends of the blades are described below.

1. Exhaust Gas Turbocharger Acceleration:

Starting from an operative condition in which blades 12 are closely engaged by the end of the annular piston 14 caused by the clamping force exerted by the fluid force created by pressure in space 15 which acts on the leftward end of the piston 14, the axial gap is substantially eliminated. Then, the next step involves decreasing the force of piston 14 against the ends of the blades 12 by ventilation of the pressure-regulating valve 19 which decreases the pressure in space 15. Then the angle of the guide blades 12 can be set by means of the adjusting device 13. Next, the pressure-setting valve 19 is activated to apply pressure from accumulator 18 to the space 15 which creates a force on piston 14 to move it rightward and closely against the end of the blades 12. This results in a substantially zero-gap spacing between the end of piston 14 and the ends of the blades 12.

If desired, a timed pressure control cycle (bleed/load) may also be used, during the adjusting movement of the cascade 11 of blades 12, using the adjusting device 13, in order to obtain the smallest possible gaps laterally or axially.

2. Engine-Braking Via Turbo-Braking:

In a first step, the above described clamping force of the annular piston 14 against the ends of the blades 12 is relieved by decreasing pressure in space 15 by ventilation of the pressure-regulating device 19. At relatively low engine rotation or speed, the angle of the guide-blades 12 is set via the guide-blade cascade adjusting device 13, dependent on a corresponding engine speed. Then a substantially zero-gap setting is subsequently established by directing control pressure to the pressure chamber or space 15. As with the first example, a timed pressure/ventilation sequence of pressure application or control can be utilized during the interim for adjusting the angle of the blades 12 by the adjusting device 13. Thus, the gap can be maintained desirably small. Eventually when the engine tends to exceed a set upper limit of rotational speed, the axial gap can be increased to limit the speed by decreasing the pressure in the pressure space 15. This produces a controlled lowering of turbocharger efficiency and therefore inhibits damage to the turbine portion.

The annular piston 14 may be designed to exhibit a degree of elastically, at least at its rightward end facing in order to ensure that the annular piston effectively engages the ends of the blades 12. This can be by providing the ends of the blades 12 with an elastic coating 27. In addition, at least one piston ring 28 is utilized to provide a seal between the pressure gas space 15 and the annular nozzle 8. This piston ring 28 may, in this case, be arranged in a groove in the casing 10 or in a groove in the annular piston 14 itself. For the sake of clarity, both possibilities are depicted as alternatives in FIGS. 2 to 5.

As seen in FIG. 2, the leftward end of each of the guide blades 12 may have a pin 29 extending into a bore 30 in the piston 14. This allows the bore 30 to act as a bearing for the pin 29 as the blade 12 is rotated during setting of the blade's angle. This provides support for the leftward end portion of the blade 12 so that it is supported at both ends. This tends to increase stability and decrease vibration.

At least one axially directed pin 26 may be provided between the annular piston 14 and the support structure. Specifically, the pin 26 extends into bores in the support structure to the left of the annular piston 14. Pin(s) 26 inhibit tilting of the annular piston 14 which would be a disadvantage in view of the support of the ends of blades 12 via the pin bearings 29.

In principle, the further exemplary embodiments described below with reference to FIGS. 3, 4 and 5 function in substantially the same manner as the exemplary embodiment explained above. Therefore, the same reference symbols have been retained for the same parts and only the modifications are explained in detail.

Figure 3:
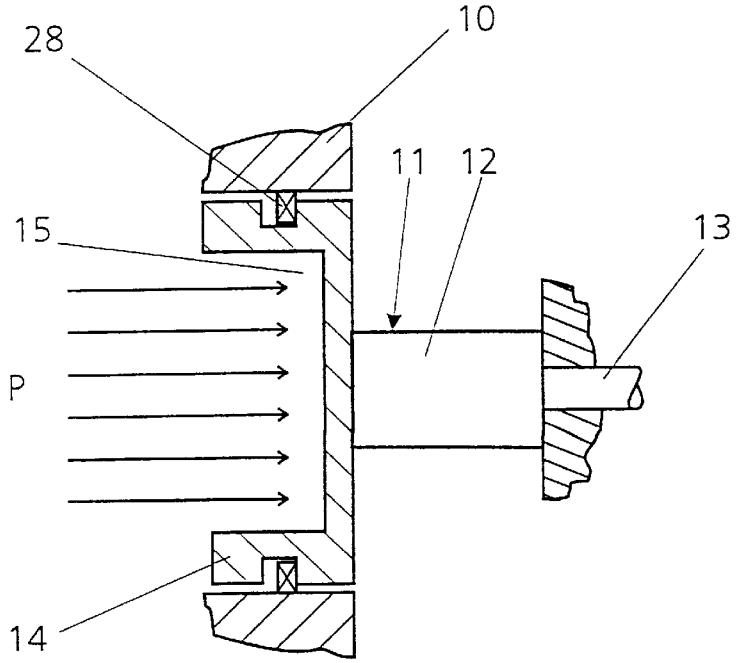
FIG. 3 is an enlarged detail view of a second piston design.

According to FIG. 3, the annular piston 14 is configured as a thin-walled member, particularly in the middle region. Also, it does not have provision to interact with guide pins 26 as in the FIG. 2 embodiment. In this case, the annular piston 14 does not serve as a secondary bearing support for the leftward end of a guide blade 11. This design is most useful for turbochargers having a lower exhaust gas force acting on the blades 12. An angle adjusting or tilting of the blades 12 may, in this case, be neutralized by a clamping action of the annular piston 14 bearing against the leftward ends of the blades 12.

As is apparent in FIG. 3, the annular piston 14 is tapered very sharply or is much thinner particularly across its middle or central region so that it bears elastically against the ends of the blades 12 under the effect of high pressure forces acting on the piston 14 from pressure space 15. Thereby, the piston 14 securely clamps the guide blades in their respective set angular positions. In this particular embodiment, annular piston 14 may likewise be actuated by compressed-air via a connection 16 under control of three-way valve 31 as disclosed in FIG. 2.

Figure 4:
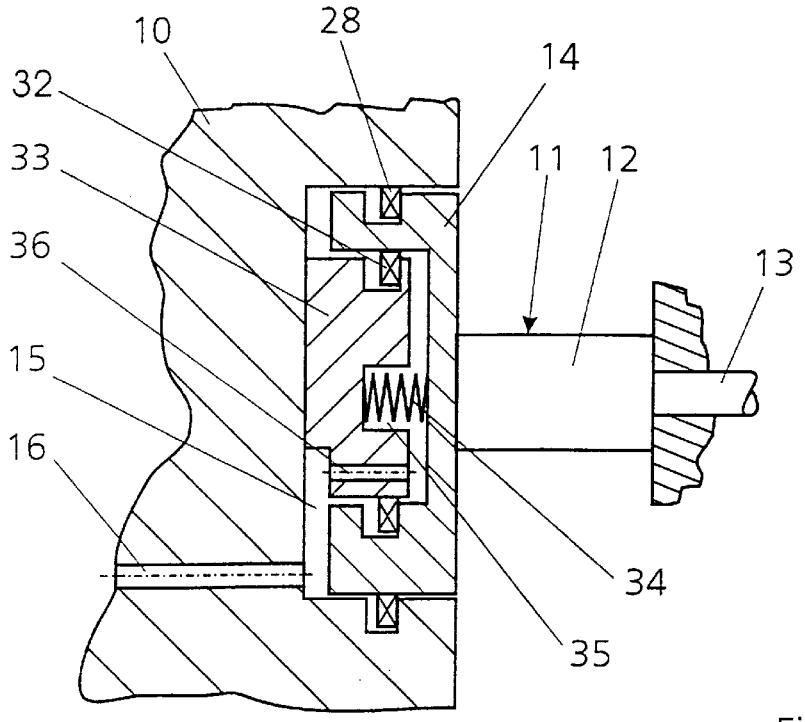
FIG. 4 is an enlarged detail view of a third piston design.

In FIG. 4, a further refinement of annular piston 14 is disclosed and a damping device or arrangement is shown. Specifically, a damping ring member 33 lies mostly within a recess formed by the central portion of annular piston 14 and is sealed via piston rings 32. As previously described, alternate support of piston ring 32 is shown first in an annular groove formed in the damping ring member 33 (upper illustration) and second in an annular groove of the annular piston 14 (lower illustration). The annular piston 14 and damping ring 33 are separated or pressed apart from one another by a spring 34. The interspace 35 between the annular piston 14 and the damping ring 33 is filled with compressed air from pressure space 15 via one or more throttle bores 36.

The damping effect of annular piston 14 is achieved in the following way: if there are pulsations of the exhaust gas flowing through the turbine portion, the annular piston 14 is capable of executing only an inhibited or delayed movement in an axial direction in relation to the turbine. Vibrations are inhibited by a slow escape of pressure from interspace 35 through the throttle bores 36 since the bores 35 have only a small diameter.

Figure 5:
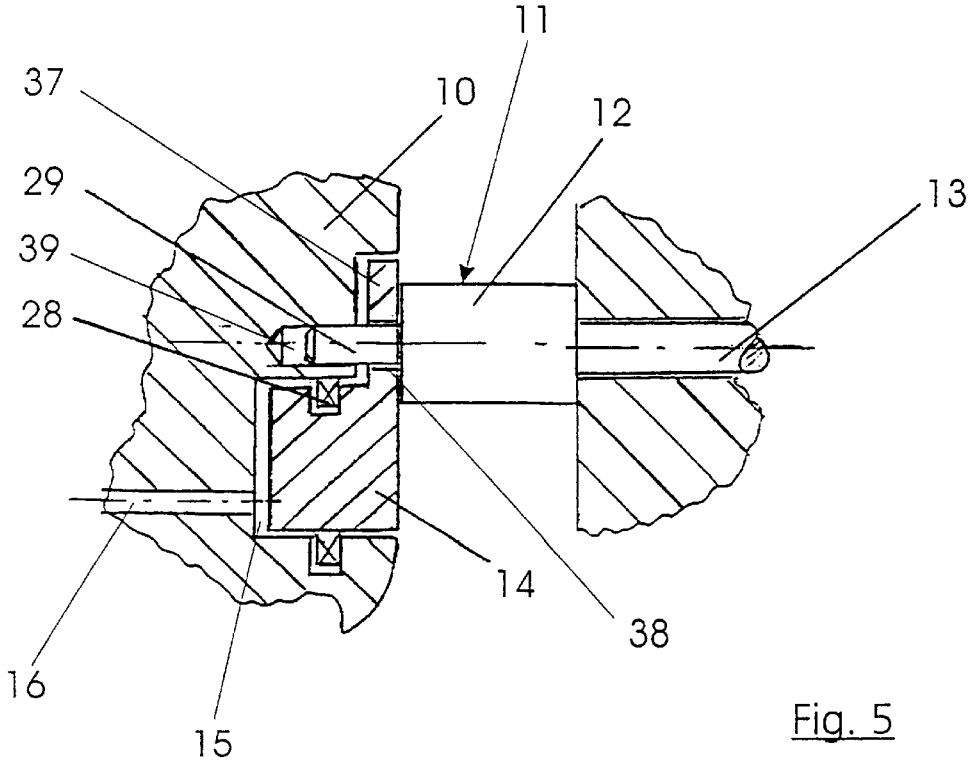
FIG. 5 is an enlarged detail view of a fourth piston design.

The embodiment or version illustrated in FIG. 5 also supports both ends of the blades 12 as in the first embodiment. In contrast to the support arrangement illustrated in FIG. 2, each pin or bearing pins 29 in this embodiment is not supported by the annular piston 14 but instead is supported by the portion of the stationary turbine casing 10 located behind the piston 14. Specifically, an oversized bore 38 is formed through the piston 14 and particularly in a radially outwardly projecting extending portion 37 of the piston 14. The bearing pin 29 extends through the bore 38 and into a bearing bore 39 formed in the casing 10.

An advantage of this type of mounting or support is that the bearing pins 29 can be press mounted in the bore 39 as a fixed shaft supported by the casing 10. Accordingly, the guide pins 26 affixed to the blades 12, as illustrated in FIG. 2, can be dispensed with. At the same time, the support of the blades at both ends improves the above described braking operation since the annular piston 14 is not subjected to great forces but the blades 12 are well supported. In this embodiment, as in FIG. 4, both alternate mounting arrangements for piston ring 28 is shown.

We claim:

1. In an turbocharger for an internal combustion engine having a housing defining an exhaust gas turbine portion including a rotor and defining a surrounding exhaust flow inlet duct with an annular nozzle opening therefrom to the rotor for directing exhaust gas flow to the rotor and having a guide-blade cascade of guide blades with their angular orientation relative to the flow direction through the nozzle opening being selectively settable by means of a guide-blade adjusting device for varying the effective flow cross-section of the nozzle opening, characterized by a gap setting device (14, 15, 16, 17) for selectively changing dimension of the gap at the ends of the guide-blade cascade (11) and the casing (10) between a substantially zero gap dimension and a maximum gap dimension.

2. The exhaust gas turbine portion as set forth in claim 1 in which an annular piston (14) is reciprocally supported by the casing wall adjacent the end portion of the guide-blade cascade (11), the casing (10) and the annular piston (14) defining a pressure space (15) to which fluid pressure can be selectively directed for controlling movement of the annular piston (14) relative to the end portions of the guide blades (12) of the guide-blade cascade (11).

3. The exhaust gas turbine portion as set forth in claim 2 and with a spring (25) urging the annular piston (14) toward the end portion of the guide-blade cascade (11).

4. The exhaust gas turbine portion as set forth in claim 2 including pins (26) provided to guide and center the annular piston (14).

5. The exhaust gas turbine portion as set forth in claim 2 and the annular piston (14) having an elastic coated end (27) facing the end portions of the guide-blades cascade (11).

6. The exhaust gas turbine potion as set forth in claim 2 in which the pressure space (15) partially defined by the annular piston (14) is selectively connected to a pressure-regulating device (19).

7. The exhaust gas turbine portion as set forth in claim 6 in which the pressure-regulating device (19) is connected to an engine control device (21) by a control line (20) for modulation of pressure in the pressure space in accord with engine operation.

8. The exhaust gas turbine portion as set forth in one of claims 2, 6, and 7 including a three-way valve (19) for alternately controlling pressurization of the pressure space (15) and having two pressure activation lines (17, 22) provided for the pressure space (15) and a stop position.

9. The exhaust gas turbine portion as set forth in claim 8 in which one of the two pressure activation lines is connected to a source of fluid pressure (18) which generates a substantial pressure, and the other of the two pressure activation lines is connected to the flow duct (7) wherein the pressure of the source of fluid pressure (18) is higher than the pressure from the flow duct (7).

10. In an turbocharger for an internal combustion engine having a housing defining an exhaust gas turbine portion including a rotor and defining a surrounding exhaust flow inlet duct with an annular nozzle opening therefrom to the rotor for directing exhaust gas flow to the rotor and having a guide-blade cascade of guide blades with their angular orientation relative to the flow direction through the nozzle opening being selectively settable by means of a guide-blade adjusting device for varying the effective flow cross-section of the nozzle opening, characterized by a gap setting device (14, 15, 16, 17) for selectively changing dimension of the gap at the ends of the guide-blade cascade (11) and the casing (10) between a substantially zero gap dimension and a maximum gap dimension.

11. The exhaust gas turbine portion as set forth in claim 10 in which an annular piston (14) is reciprocally supported by the casing wall adjacent the end portion of the guide-blade cascade (11), the casing (10) and the annular piston (14) defining a pressure space (15) to which fluid pressure can be selectively directed for controlling movement of the annular piston (14) relative to the end portions of the guide blades (12) of the guide-blade cascade (11).

12. The exhaust gas turbine portion as set forth in claim 11 in which the annular piston (14) has a central thin-walled configuration.

13. The exhaust gas turbine portion as set forth in claim 11 and including at least one pin bearing (29) mounted in a bore (30) formed in the annular piston (14) and engaging the end of the guide blades (12) away from the guide-blade cascade adjusting device (13).

14. The exhaust gas turbine portion as set forth in claim 12 and including at least one pin bearings (29) extending through bores (38) in an extension ring portion (37) of the annular piston (14) and inserted in bearing bores (39) in the casing (10) away from the guide-blade cascade adjusting device (13).

15. The exhaust gas turbine portion as set forth in claim 11 in which a damping ring (33) is supported within the annular piston (14) between it and the casing (10) and a spring (34) urges the annular piston (14) and damping ring (33) apart from one another, an interspace (35) is defined between the annular piston (14)and the damping ring (33) with at least one throttle bore (36)connecting the piston space (15) and the interspace (35).

16. A regulatory system for an exhaust gas turbine portion of an exhaust gas turbocharger for an internal combustion engine including a rotor and having a casing defining a surrounding exhaust flow inlet duct with an annular nozzle opening therefrom to the rotor for directing exhaust gas flow to the rotor and having a guide-blade cascade of guide blades with their angular orientation relative to the flow direction through the nozzle opening being selectively settable by means of a guide-blade cascade adjusting device for varying the effective flow cross-section of the nozzle opening, characterized in that a gap setting device (14, 15) is controlled by a pressure regulating device (19) for selectively providing a gap dimension between the gap setting device (14) and the ends of the guide-blade cascade (11) between a substantially zero dimension gap and a maximum dimension gap.

17. A turbocharger for an internal combustion engine having a housing defining an exhaust gas turbine portion including a rotor and defining a surrounding exhaust flow inlet duct with an annular nozzle opening leading from said inlet duct to the rotor for directing exhaust gas flow to the rotor, and a guide-blade structure disposed in said nozzle opening and having guide blades whose angular orientation relative to the flow direction through the nozzle opening is selectively settable by means of a guide-blade adjusting device connected to one axial end of said guide blade structure for varying the effective flow cross-section of the nozzle opening, a gap setting device disposed adjacent the other axial end of said guide blade structure for selectively changing the dimension of the axial gap between the other axial end of the guide-blade structure and the housing between a substantially zero gap dimension and a maximum gap dimension, said gap setting device including an annular piston reciprocally supported in the wall of said housing adjacent the other axial end of the guide-blade structure, said annular piston defining at its end opposite said guide blades a pressure space to which fluid under pressure can be selectively directed for controlling axial movement of the annular piston relative to the axial end of the guide blades of the guide-blade structure for adjusting any gap between the annular piston and the guide-blade structure.

18. A turbocharger according to claim 17, further comprising a spring urging said annular piston toward said guide blade structure.

19. A turbocharger according to claim 17, wherein pins are provided between said housing and said annular piston for guiding and centering said annular piston.

20. A turbocharger according to claim 17, wherein said annular piston has an elastic coated end facing said guide blade structure.

21. A turbocharger according to claim 17, wherein said pressure space, which is partially defined by said annular piston, is connected to a pressure supply line which includes a pressure-regulating device.

22. A turbocharger according to claim 17, wherein said pressure-regulating device is connected to an engine control device by a control line for controlling the pressure in the pressure space in accordance with engine operating conditions.

23. A turbocharger according to claim 17, wherein a three-way valve is provided for alternatively controlling pressurization of said pressure space by way of a first and a second pressurization line for the pressure space.

24. A turbocharger according to claim 23, wherein said first pressurization line is connected to a source of fluid pressure and said second pressurization line is connected to a flow duct, wherein the pressure of the source of fluid pressure is higher than the pressure in the flow duct.

* * * * *